US006450834B1

(12) United States Patent
Polgar et al.

(10) Patent No.: US 6,450,834 B1
(45) Date of Patent: Sep. 17, 2002

(54) PANEL MOUNTING SYSTEM FOR ELECTRICAL CONNECTORS

(75) Inventors: Gary E. Polgar, Bolingbrook; Michael A. Bandura, Naperville, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/013,228

(22) Filed: Dec. 10, 2001

(51) Int. Cl.[7] ..... H01R 13/66; H01R 13/64
(52) U.S. Cl. ..... 439/546; 439/247
(58) Field of Search ..... 439/544, 545, 439/546, 547, 548, 549, 550, 248, 571, 247

(56) References Cited

U.S. PATENT DOCUMENTS

| | | | | |
|---|---|---|---|---|
| 3,753,212 A | | 8/1973 | Yamada et al. | 339/91 |
| 4,312,558 A | | 1/1982 | Duerr et al. | 339/130 |
| 5,123,862 A | | 6/1992 | Suzuki | 439/533 |
| 5,286,222 A | | 2/1994 | Yagi et al. | 439/607 |
| 5,407,363 A | | 4/1995 | Polgar et al. | 439/546 |
| 5,575,673 A | | 11/1996 | Dahlem et al. | 439/248 |
| 5,772,469 A | | 6/1998 | Polgar et al. | 439/546 |
| 5,888,093 A | * | 3/1999 | Polgar et al. | 439/546 |
| 5,980,313 A | | 11/1999 | Kunishi et al. | 439/545 |
| 5,984,721 A | | 11/1999 | Self, Jr. et al. | 439/546 |
| 6,200,163 B1 | | 4/2001 | O'Sullivan | 439/579 |
| 6,210,217 B1 | | 4/2001 | Ping | 439/557 |
| 6,290,536 B1 | | 9/2001 | Hwang et al. | 439/553 |

* cited by examiner

*Primary Examiner*—Renee Luebke
*Assistant Examiner*—Briggitte R. Hammond
(74) *Attorney, Agent, or Firm*—Stephen Z. Weiss

(57) ABSTRACT

A connector panel mounting system includes first and second panels each having a given thickness between respective insertion surfaces and mating surfaces thereof and an opening with a locating notch in an edge of the opening. First and second connectors each include dielectric housings insertable from the insertion surfaces of the respective panels to insertion positions into the respective openings. Each housing has an outwardly extending locating flange for passing through the locating notch of the opening in the respective panel as the housing is inserted thereinto. The housing of each connector is movable from its insertion position to a mounted position whereat the locating flange thereof abuts the mating surface of the respective panel. The housing of each connector has a recess aligned with the locating notch of the opening in the respective panel when the housing is in its mounted position. When the connectors are mated through the openings in their respective panels, the panels can be juxtaposed, with the locating flange of each connector mounted on its respective panel passing through the locating notch of the opposite panel and into the recess of the housing of the other connector.

16 Claims, 4 Drawing Sheets

PANEL MOUNTING SYSTEM FOR ELECTRICAL CONNECTORS

FIELD OF THE INVENTION

This invention generally relates to the art of electrical connectors and, particularly, to a system for mounting an electrical connector assembly through a pair of juxtaposed panels.

BACKGROUND OF THE INVENTION

Panel mounted electrical connectors typically include a dielectric housing mounting a plurality of electrically conductive terminals. The housing also includes means for mounting the connector to a panel. A panel mounted connector typically is mateable with other electrical apparatus through the panel, such as another connector which, in turn, may be mounted to a second panel, a circuit board, a cable or discrete electrical wires.

The dielectric housing is insertable from one surface of a panel along an axis to an insertion position into an opening in the panel. The housing has at least one radially extending locating flange for passing through a locating portion of the opening as the housing is inserted thereinto. The housing is movable from its insertion position to a mounted position whereat the locating flange can abut the opposite side of the panel to prevent axial removal of the housing back out of the opening.

There are applications wherein it is desirable to locate a pair of panels in immediately juxtaposed relationship. In other words, opposing surfaces of the panel are in close proximity, if not actually abutting. With a typical panel mounted connector as described above, the locating flange which abuts the opposite surface of the panel to prevent axial removal of the connector housing back out of the opening in the panel, prevents a second panel from being located in close juxtaposition to the first panel. In order to solve this problem, one panel mounting system incorporates a bracket or other extraneous mounting mechanism to mount the connector entirely on one side of a panel, with no portion of the connector located on the opposite side of the panel. Therefore, a pair of panels can be located in immediate juxtaposition relative to each other. Unfortunately, the use of brackets or other extraneous mounting mechanisms requires additional labor and adds additional costs to the overall panel mounting system.

The present invention is directed to a panel mounting system wherein a pair of connectors can be mated through aligned openings in a pair of juxtaposed panels without any extraneous mounting mechanisms whatsoever. The system is extremely simple and very cost-effective.

SUMMARY OF THE INVENTION

An object, therefore, of the invention is to provide a new and improved panel mounting system for electrical connectors mounted to a pair of juxtaposed panels.

In the exemplary embodiment of the invention, a first panel has a given thickness between an insertion surface and a mating surface and includes a first opening with a locating notch in an edge of the opening. A first connector includes a first dielectric housing insertable from the insertion surface of the first panel to an insertion position into the first opening. The housing has an outwardly extending locating flange for passing through the locating notch of the first opening as the housing is inserted thereinto. The housing is movable from its insertion position to a mounted position whereat the locating flange abuts the mating surface of the first panel. The housing has a first recess aligned with the locating notch of the first opening when the housing is in its mounted position.

A second panel has a given thickness between an insertion surface and a mating surface and includes a second opening with a locating notch in an edge of the second opening. A second connector includes a second dielectric housing insertable from the insertion surface of the second panel to a insertion position into the second opening. The second housing has an outwardly extending locating flange for passing through the locating notch of the second opening as the second housing is inserted thereinto. The second housing is movable from its insertion position to a mounted position whereat the locating flange thereof abuts the mating surface of the second panel. The second housing has a second recess aligned with the locating notch of the second opening when the second housing is in its mounted position.

The first and second connectors are mateable through the openings in the panels when the mating surfaces of the panels are juxtaposed. The locating flange of each connector mounted on its respective panel passes through the locating notch of the opposite panel and into the recess of the housing of the other connector. Therefore, the locating flanges do not interfere with placing the panels in close juxtaposition.

In the preferred embodiment, each connector is insertable into the opening in its respective panel on an insertion axis. Each connector is rotatable about the respective axis between the insertion and mounting positions. The opening in each panel includes a pair of the locating notches disposed at diametrically opposite edges of the opening. The housing of each connector includes pair of locating flanges at opposite sides thereof for passing through the pair of locating notches. The housing of each connector also includes a pair of the recesses angularly spaced from the locating flanges for alignment with the locating notches when the connectors are in their mounted positions. As disclosed herein, the opening in at least one of the panels is generally circular.

A feature of the invention includes the opening in at least one of the panels being larger than the cross-sectional configuration of a portion of the housing of the respective connector inserted into the opening. This provides relative floating movement between the respective connector and the at least one panel.

Other objects, features and advantages of the invention will be apparent from the following detailed description taken in connection with the accompanying drawings.

BRIEF DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 9:
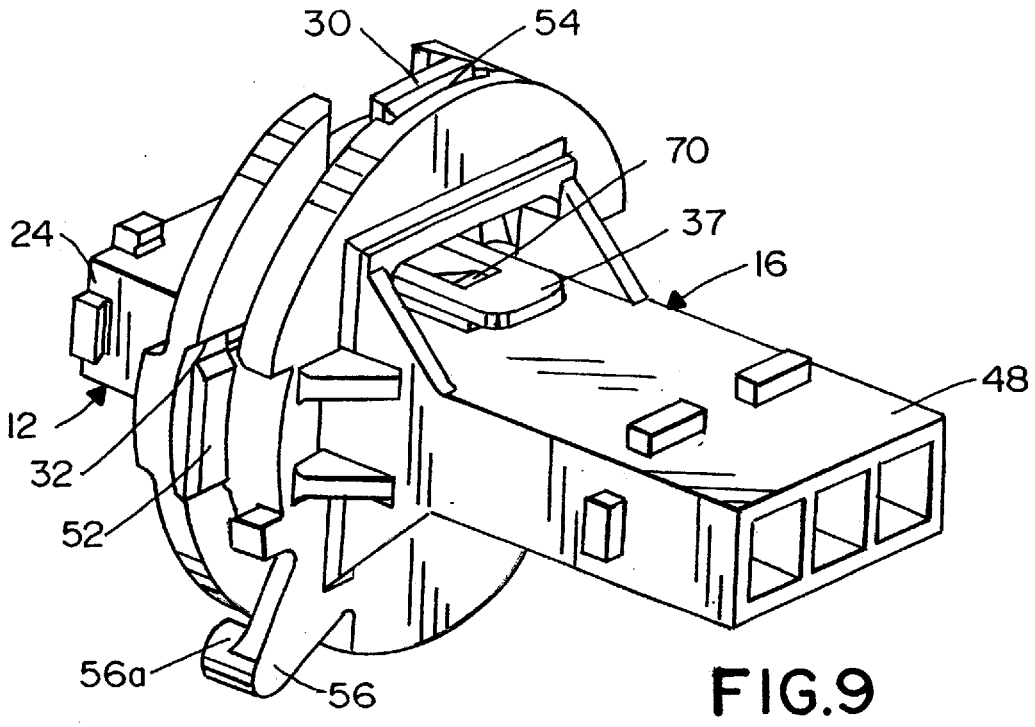
FIG. 9 is a perspective view showing the plug and receptacle connectors in mated condition, with the panels eliminated to facilitate the illustration.
Figure 10:
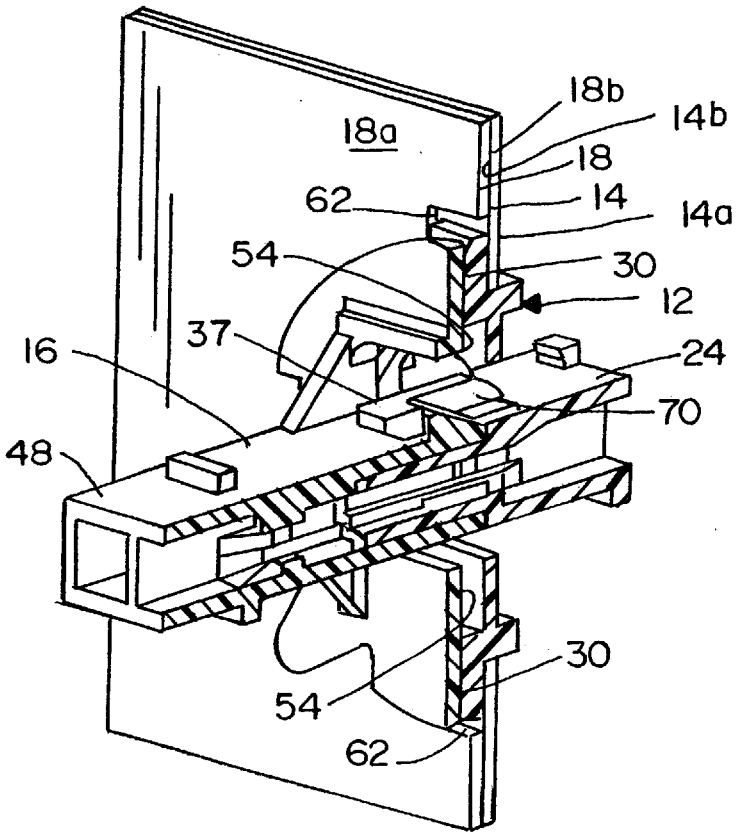
FIG. 10 is an axial section through the mated connectors with the panels in juxtaposed relationship.

Referring to the drawings in greater detail, FIGS. 1–4 show a first or receptacle connector, generally designated 12, for mounting to a panel 14, and FIGS. 5–8 show a second or plug connector, generally designated 16, for mounting to a second panel 18. The two connectors 12 and 16 are mateable as seen in FIG. 9, and the mated connectors allow the two panels to be located in immediate juxtaposition relative to each other as shown in FIG. 10. Although the disclosure is directed to an electrical connector, it should be understood that the term "connector" herein and in the claims hereof is not limited to electrical connectors, and the concepts of the invention are equally applicable for other connecting devices such as fiber optic connectors and the like.

Figure 1:
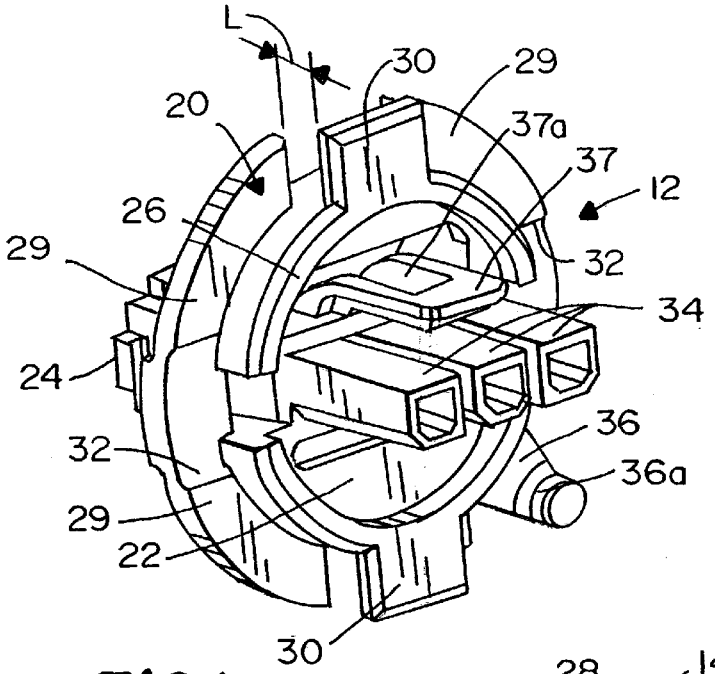
FIG. 1 is a perspective view of the mating side of a first or receptacle connector incorporating the concepts of the invention.

With that understanding, and referring first to FIG. 1, receptacle connector 12 includes a housing, generally designated 20, which is preferably fabricated of a dielectric material such as plastic. The housing defines a mating side 22 and a terminating side 24 which may receive a complementary connecting device. Mating side 22 includes a circular insertion portion 26 for insertion through a generally circular opening 28 (FIG. 2) in panel 14 and holding flanges 29 designed to prevent the connector 12 from passing completely through openings 28. A pair of locating flanges 30 project radially outwardly from circular insertion portion 26 on diametrically opposite sides thereof. The housing has a pair of recesses 32 on diametrically opposite sides thereof and are angularly displaced equidistant between locating flanges 30. The flanges 30 are spaced apart from the flanges 29 by a slot 100 having a depth L. It can be seen clearly in FIG. 1 that recesses 32 are open in a direction away from mating side 22 of the connector. In other words, the recesses open in a mating direction toward a mating connector such as plug connector 16 when the connectors are mated.

Still referring to FIG. 1, housing 20 of receptacle connector 12 includes a plurality (three) silos 34 projecting from mating side 22 in the mating direction. Connector 12 is called a "receptacle" connector because silos 34 house female conductive terminals. A lock arm 36 projects radially outwardly from housing 20 and includes an axially extending locking boss 36*a* at the distal end of the lock arm. Finally, a latch tongue 37, having an aperture 37*a*, projects axially from mating side 22 in the mating direction.

Figure 2:
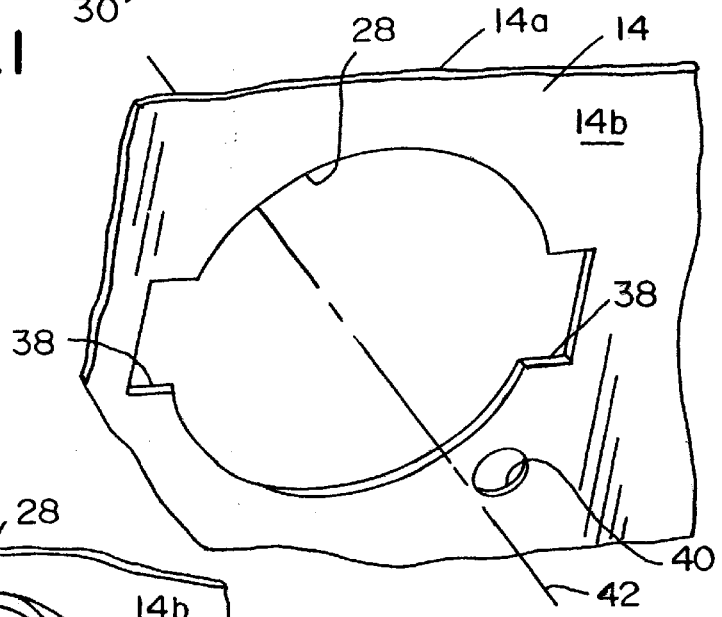
FIG. 2 is a perspective view of a first or receptacle panel on which the receptacle connector of FIG. 1 is mounted.

Referring to FIG. 2, opening 28 in first panel 14 includes a pair of locating notches 38 radiating outwardly from the opening at diametrically opposite sides thereof. A locking hole 40 is formed through panel 14 spaced outwardly from opening 28. The panel has an insertion surface 14*a* and a mating surface 14*b*. Opening 28 has an insertion axis 42.

Figure 3:
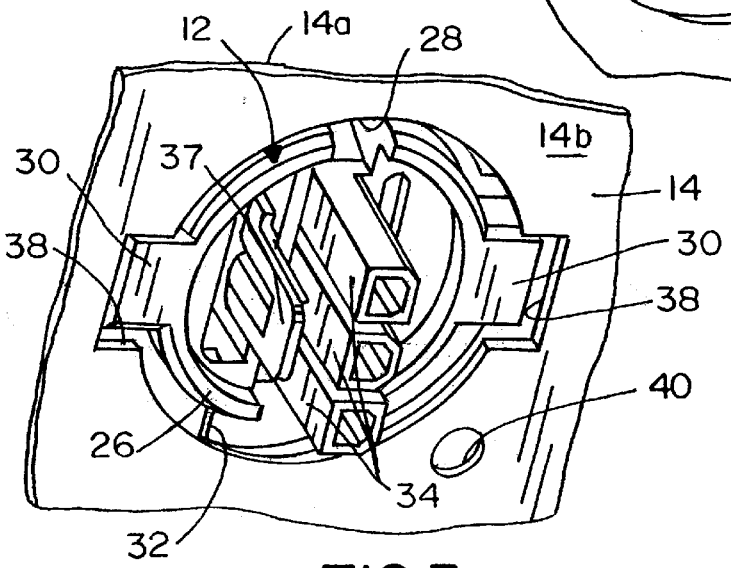
FIG. 3 is a perspective view of the receptacle connector being inserted through the panel to its insertion position.

FIG. 3 shows the receptacle connector 12 aligned with the panel openings 28 and disposed on insertion axis 42 (FIG. 2) into the opening 28 in panel 14 to what can be called an insertion position. During insertion, circular insertion portion 26 of the connector housing passes into opening 28 in panel 14, and the locating flanges 30 of the connector pass through locating notches 38 of the opening.

Figure 4:
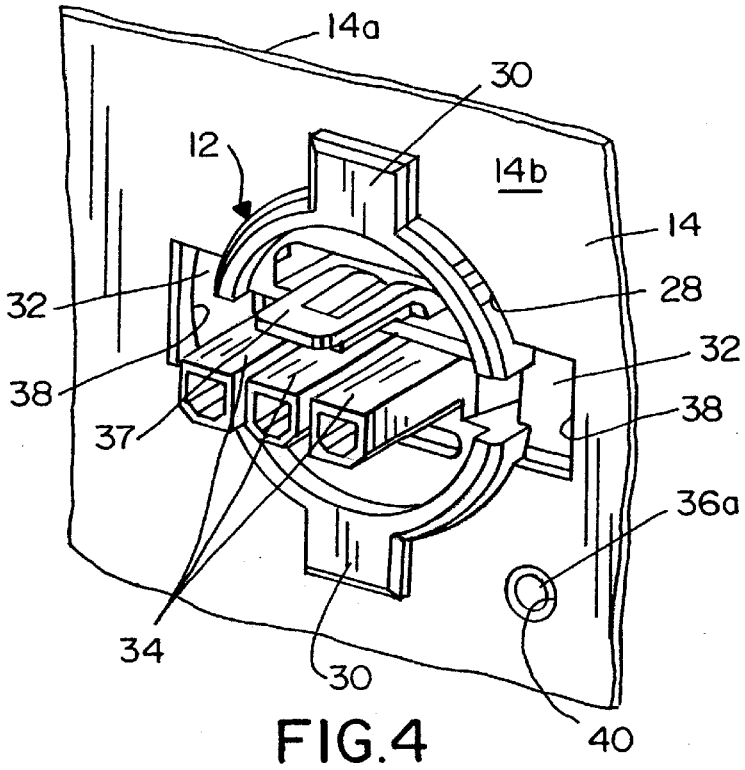
FIG. 4 is a perspective view showing the receptacle connector having been rotated from its insertion position to its mounted position.

In order to mount and lock receptacle connector 12 to panel 14 within opening 28, the connector is rotated about insertion axis 42 from its insertion position (FIG. 3) to a mounted position shown in FIG. 4 in a manner similar to bayonet style mounting arrangements used with camera lenses and the like, so that the panel wall 14 near the perimeter of the opening 28 is received within the slot 100 formed between the flanges 29 and 30. In the mounted position, locating flanges 30 have been rotated approximately 90° and into abutting relationship with mating surface 14*b* of panel 14. Therefore, the connector cannot be backed out of opening 28. When so rotated, locking boss 36*a* at the distal end of lock arm 36 (FIG. 1) resiliently snaps into locking hole 40 in panel 14 to prevent the connector from rotating away from its mounted position. It is important to note in FIG. 4 that recesses 32 of the connector housing are located in alignment with locating notches 38 of the panel.

Figure 5:
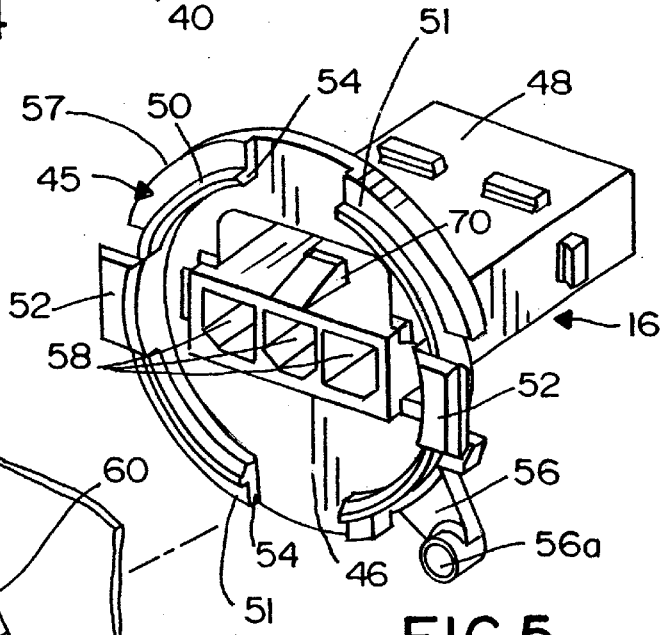
FIG. 5 is a perspective view looking at the mating side of a second or plug connector incorporating the concepts of the invention.

Referring to FIG. 5, the second or plug connector 16 is constructed similar to receptacle connector 12 in that the plug connector includes a dielectric housing, generally designated 45, defining a mating side 46 and a terminating side 48. A circular insertion portion 50 projects away from mating side 46 in the mating direction. Holding flanges 51 are provided to prevent plug connector 16 from passing completely through openings 60. A pair of locating flanges 52 radiate outwardly of the insertion portion at diametrically opposite sides thereof, and a pair of recesses 54 are located angularly from and equidistant between locating flanges 52. A lock arm 56 projects radially outwardly of the housing and terminates in a locking boss 56*a*. Three receptacles 58 are formed in mating side 46 for receiving the three silos 34 (FIG. 1) of receptacle connector 12. Connector 16 is called a "plug" connector because three male conductive terminals are located within receptacles 58 for electrically engaging the female terminals within silos 34 of receptacle connector 12.

Figure 6:
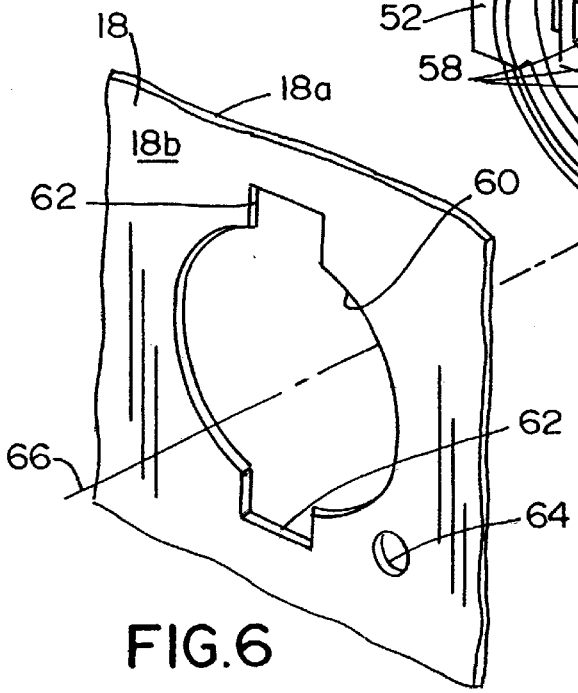
FIG. 6 is a perspective view of a second panel for receiving the plug connector.

Second panel 18 in FIG. 6 is similar to first panel 14 in that it includes an insertion surface 18*a* and a mating surface 18*b* and an opening 60 for receiving circular insertion portion 50 of plug connector 16. A pair of locating notches 62 radiate outwardly at diametrically opposite edges of opening 60 for receiving locating flanges 52 of connector 16. A locking hole 64 is spaced outwardly from opening 60 for receiving locking boss 56*a* on lock arm 56 of connector 16. Opening 60 defines an insertion axis 66.

Figure 7:
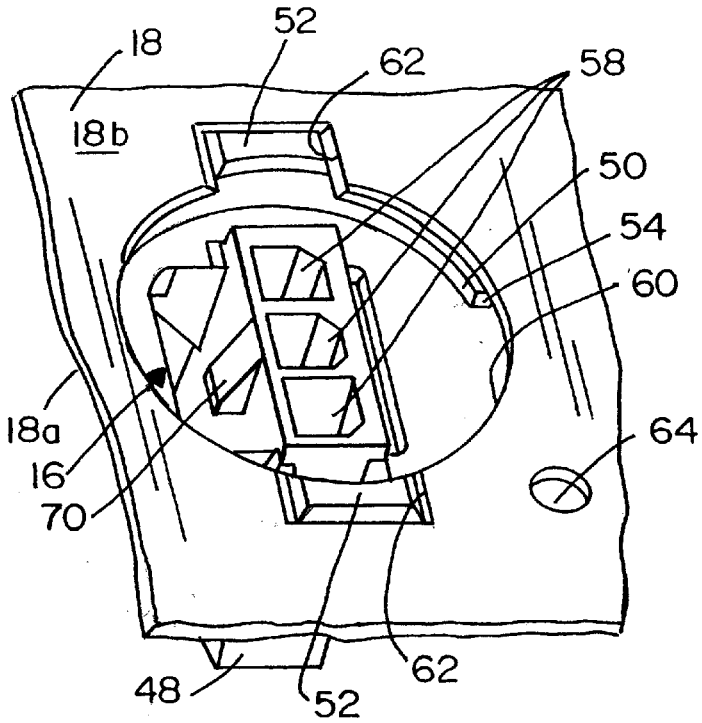
FIG. 7 is a perspective view showing the plug connector inserted through the opening in the second panel to its insertion position.

FIG. 7 shows plug connector 16 having been inserted into opening 60 in second panel 18 similar to the insertion of receptacle connector 12 into the opening in first panel 14 as described above in relation to FIG. 3. Specifically, when plug connector 16 is inserted on insertion axis 66 (FIG. 6) into opening 60, circular insertion portion 50 moves into opening 60 as seen in FIG. 7, as locating flanges 52 pass through locating notches 62, to an insertion position of the connector relative to the panel.

Figure 8:
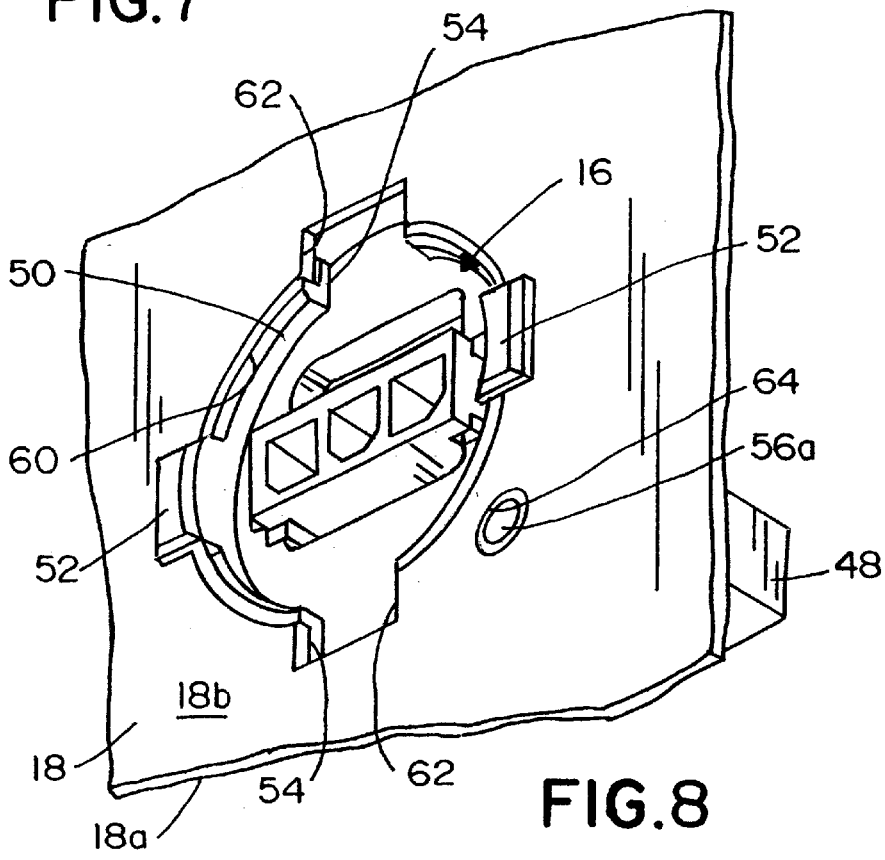
FIG. 8 is a perspective view showing the plug connector rotated from its insertion position to its mounted position.

Like receptacle connector 12, plug connector 16 is rotated approximately 90° to a mounted position shown in FIG. 8. In the mounted position, locating flanges 52 move into abutting relationship with mating surface 18*b* of panel 18. Recesses 54 in the connector housing are aligned with locating notches 62 of the panel 18 in the mounted position of the connector. The connector is held in its mounted position by locking boss 56*a* snapping into locking hole 64 in the panel.

FIG. 9 shows receptacle connector 12 mated with plug connector 16, with the panels removed for clarity. Apertured latch tongue 37 of connector 12 engages a latch boss 70 of connector 16. Advantageously, it can be seen that locating flanges 30 of the receptacle connector 12 are located within recesses 54 of plug connector 16. The locating flanges 52 of the plug connector 16 are located within recesses 32 of the receptacle connector 12 when the two connectors are engaged together. This allows the mating faces (e.g., circular insertion portions 26 and 50) to be in substantial abutment notwithstanding the fact that the locating flanges of each connector project completely through the opening in the connector's respective panel and into abutment with the opposite or mating surface of the respective panel.

FIG. 10 follows through on the description immediately above regarding the mating connectors in FIG. 9. In other words, FIG. 10 shows that first panel 14 to which receptacle connector 12 is mounted is immediately juxtaposed against second panel 18 to which plug connector 16 is mounted. The panels can be immediately juxtaposed, or actually placed in an abutting flush mounted relationship, because locating flanges 30 and 52 of receptacle and plug connectors 12 and 16, respectively, are nested within recesses 54 and 32, respectively, of the plug and receptacle connectors. Because of the nesting relationship, the locating flanges do not prevent the panels from being located immediately adjacent to each other or, in a complete abutting flush relationship. This is accomplished without the need of any brackets, extraneous mounting hardware, or additional stamped and formed portions of the panels whatsoever. Opening 28, opening 60, and hole 64 in panels 14 and 18, respectively, may be larger than insertion portion 26, insertion portion 50, and locking boss 56*a* of connectors 12 and 16, respectively, to provide relative floating movement between the connectors and their respective panels.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector panel mounting system, comprising:

a first panel having a given thickness between an insertion surface and a mating surface and including a first opening with a locating notch in an edge of the opening;

a first connector including a first housing insertable from the insertion surface of the first panel to an insertion position into the first opening, the housing having an outwardly extending locating flange for passing through the locating notch of the first opening as the housing is inserted thereinto, the housing being movable from its insertion position to a mounted position whereat the locating flange abuts the mating surface of the first panel, the housing having a first recess aligned with the locating notch of the first opening when the housing is in its mounted position;

a second panel having a given thickness between an insertion surface and a mating surface and including a second opening with a locating notch in an edge of the second opening;

a second connector including a second housing insertable from the insertion surface of the second panel to an insertion position into the second opening, the second housing having an outwardly extending locating flange for passing through the locating notch of the second opening as the second housing is inserted thereinto, the second housing being movable from its insertion position to a mounted position whereat the locating flange thereof abuts the mating surface of the second panel, the second housing having a second recess aligned with the locating notch of the second opening when the second housing is in its mounted position; and said connectors being mateable through the openings in the panels when the mating surfaces of the panels are juxtaposed, with the locating flange of each connector mounted on its respective panel passing through the locating notch of the opposite panel and into the recess of the housing of the other connector.

2. The connector panel mounting system of claim 1 wherein the opening in at least one of the panels is larger than the cross-sectional configuration of a portion of the housing of the respective connector inserted into the opening of the at least one panel to provide relative floating movement between the respective connector and the at least one panel.

3. The connector panel mounting system of claim 1 wherein the opening in each panel includes a pair of the locating notches disposed at diametrically opposite edges of the opening, the housing of each connector includes a pair of the locating flanges at opposite sides thereof for passing through the pair of locating notches, and the housing of each connector includes a pair of said recesses aligned with the locating notches when the connectors are in their mounted positions.

4. The connector panel mounting system of claim 1 wherein each connector is insertable into the opening in its respective panel on an insertion axis, and each connector is rotatable about the respective axis between the insertion and mounting positions.

5. The connector panel mounting system of claim 4 wherein the locating flange and the recess of the housing of each connector are angularly spaced from each other about the respective insertion axis of the connector.

6. The connector panel mounting system of claim 4 wherein the opening in at least one of the panels is generally circular.

7. The connector panel mounting system of claim 4 wherein the opening in at least one of the panels is larger than the cross-sectional configuration of a portion of the housing of the respective connector inserted into the opening of the at least one panel to provide relative floating movement between the respective connector and the at least one panel.

8. The connector panel mounting system of claim 4 wherein the opening in each panel includes a pair of the locating notches disposed at diametrically opposite edges of the opening, the housing of each connector includes a pair of the locating flanges at opposite sides thereof for passing through the pair of locating notches, and the housing of each connector includes a pair of said recesses aligned with the locating notches when the connectors are in their mounted positions.

9. A connector panel mounting system, comprising:

a first panel having a given thickness between an insertion surface and a mating surface and including a first, generally circular opening with a pair of locating notches in diametrically opposite edges of the opening;

a first connector including a first housing insertable from the insertion surface of the first panel to an insertion position into the first opening, the housing having a pair of locating flanges on diametrically opposite sides thereof for passing through the locating notches of the first opening as the housing is inserted thereinto, the housing being rotatable from its insertion position to a mounted position whereat the locating flanges abut the mating surface of the first panel, the housing having a pair of recesses aligned with the locating notches of the first opening when the housing is in its mounted position;

a second panel having a given thickness between an insertion surface and a mating surface and including a second, generally circular opening with a pair of locating notches in diametrically opposite edges of the second opening;

a second connector including a second housing insertable from the insertion surface of the second panel to an insertion position into the second opening, the second housing having a pair of outwardly extending locating flanges for passing through the locating notches of the second opening as the second housing is inserted thereinto, the second housing being rotatable from its insertion position to a mounted position whereat the locating flanges thereof abut the mating surface of the second panel, the second housing having a pair of second recesses aligned with the locating notches of the second opening when the second housing is in its mounted position; and said connectors being mateable through the openings in the panels when the mating surfaces of the panels are juxtaposed, with the locating flanges of each connector mounted on its respective panel passing through the locating notches of the opposite panel and into the recesses of the housing of the other connector.

10. The connector panel mounting system of claim 9 wherein the opening in at least one of the panels is larger than the cross-sectional configuration of a portion of the housing of the respective connector inserted into the opening of the at least one panel to provide relative floating movement between the respective connector and the at least one panel.

11. A connector panel mounting system, comprising:

a first panel having a given thickness between an insertion surface and a mating surface and including a first opening with a locating notch in an edge of the opening;

a first connector including a first housing insertable from the insertion surface of the first panel to an insertion position into the first opening, the housing having an outwardly extending locating flange for passing through the locating notch of the first opening as the housing is inserted thereinto, the housing being movable from its insertion position to a mounted position whereat the locating flange abuts the mating surface of the first panel;

a second panel having a given thickness between an insertion surface and a mating surface and including a second opening with a locating notch in an edge of the second opening;

a second connector including a second housing mounted to the insertion surface of the second panel and including a recess aligned with the locating notch of the second opening; and said connectors being mateable through the openings in the panels when the mating surfaces of the panels are juxtaposed, with the locating flange of the first connector mounted on the first panel passing through the locating notch of the second panel and into the recess of the housing of the second connector.

12. The connector panel mounting system of claim 11 wherein said first connector is insertable into the opening in the first panel on an insertion axis and is rotatable about the axis between the insertion and mounting positions.

13. The connector panel mounting system of claim 12 wherein the locating flange of the housing of the first connector and the recess of the housing of said second connector are angularly spaced from each other about the insertion axis.

14. The connector panel mounting system of claim 12 wherein the opening in said first panel is generally circular.

15. The connector panel mounting system of claim 12 wherein the opening in the first panel is larger than the cross-sectional configuration of a portion of the housing of the first connector to provide relative floating movement between the first connector and the first panel.

16. The connector panel mounting system of claim 12 wherein the opening in each panel includes a pair of the locating notches disposed at diametrically opposite edges of the opening, the housing of the first connector includes a pair of locating flanges at opposite sides thereof for passing through the pair of locating notches, and the housing of the second connector includes a pair of said recesses aligned with the locating notches when the connectors are in their mounted positions.

* * * * *